US007900774B2

(12) United States Patent
Stroster

(10) Patent No.: US 7,900,774 B2
(45) Date of Patent: Mar. 8, 2011

(54) KIT AND/OR METHOD FOR STORING AND/OR FOR DISPLAYING GIFT WRAPPING AND/OR ACCESSORIES

(76) Inventor: Maria Stroster, Chicago, IL (US)

( * ) Notice: Subject to any disclaimer, the term of this patent is extended or adjusted under 35 U.S.C. 154(b) by 0 days.

(21) Appl. No.: 12/317,898

(22) Filed: Dec. 30, 2008

(65) Prior Publication Data

US 2010/0163451 A1 Jul. 1, 2010

(51) Int. Cl.
*B65D 69/00* (2006.01)

(52) U.S. Cl. ..... 206/575; 206/395; 206/407; 206/459.5; 229/93

(58) Field of Classification Search ..... 206/389, 206/395, 407, 575, 464, 146, 393, 398, 769, 206/770, 771, 781, 225, 226, 459.5; 229/93
See application file for complete search history.

(56) References Cited

U.S. PATENT DOCUMENTS

| | | | | | |
|---|---|---|---|---|---|
| 1,221,785 | A * | 4/1917 | williams | 229/115 |
| 1,897,143 | A * | 2/1933 | Powell | 206/395 |
| 1,995,183 | A * | 3/1935 | Kovnat | 229/304 |
| 3,258,188 | A * | 6/1966 | Houston | 229/120.33 |
| 3,884,351 | A * | 5/1975 | James | 206/225 |
| 4,566,592 | A * | 1/1986 | Klukos | 206/449 |
| 2007/0062080 | A1 * | 3/2007 | Bramhall | 40/124.06 |

* cited by examiner

*Primary Examiner* — J. Gregory Pickett
*Assistant Examiner* — Raven Collins
(74) *Attorney, Agent, or Firm* — Patents+TMS, P.C.

(57) ABSTRACT

A kit and/or a method for storing and/or for displaying gift wrapping and/or accessories are provided. A sleeve has a plurality of walls that form a geometric cross-section capable of resisting a crushing of the contents of the sleeve. An insert is sized for insertion into the sleeve adjacent to one or more of the plurality of walls. The accessories are affixed to the insert between the insert and one or more of the plurality of walls of the sleeve to maintain a position of the accessories for display through the sleeve. Cutouts and/or windows of transparency and/or translucency in one or more of the plurality of walls of the sleeve allow a purchaser to view the contents of the sleeve.

15 Claims, 8 Drawing Sheets

KIT AND/OR METHOD FOR STORING AND/OR FOR DISPLAYING GIFT WRAPPING AND/OR ACCESSORIES

BACKGROUND OF THE INVENTION

The present invention generally relates to a kit and/or a method for storing and/or for displaying gift wrapping and/or accessories. More specifically, the present invention relates to a kit and/or a method for storing and/or for displaying gift wrapping, such as, for example, a roll of wrapping paper and/or accessories, such as, for example, ribbon, a greeting card, an envelope and/or the like. The kit and/or the method may have a sleeve that may have, preferably, a triangular cross-section. The sleeve may be, preferably, transparent and/or translucent and may be sized to receive the gift wrapping and may be shaped to prevent damage to the gift wrapping. Further, the kit and/or the system may have an insert that may be sized for insertion into the sleeve. The insert may be configured to store and/or display the gift wrapping and/or the accessories through one or more walls of the sleeve. Moreover, the gift wrapping and/or the accessories may be coordinated to match in color and/or style.

It is generally known that accouterments required to wrap a gift are often sold separately in retail stores. A purchaser who enters a retail store with the intention to buy the accouterments typically must select wrapping paper, bows, ribbon, greeting cards and/or the like separately. However, the purchaser often buys all of the accouterments required to wrap the gift in the same visit to the retail store in the interest of having a consistent theme for decorating the gift. The accouterments come individually wrapped and individually priced and often do not match to provide the purchaser with the consistent theme.

In many retail stores, the accouterments are not located on a same aisle or in a same section of the retail stores. A separation displayed and the fixtures where the ribbons and bows are displayed.

Of course, it is generally known that the purchaser may often desire to wrap only a single gift. Buying individually packaged wrapping paper, a single greeting card with an envelope and a matching ribbon or bow is costly and time-consuming for a purchaser who desires to wrap only a single gift. Further, the purchaser is often forced to buy more wrapping paper and ribbon than what is required to wrap the single gift. This surplus of accouterments results in leftover wrapping paper and/or ribbon that requires space for safe-keeping and/or later use by the purchaser. Even further, the purchaser who is forced to buy more accouterments than required to wrap the single gift spends more money than is required to wrap the single gift. And still, the purchaser wastes excessive amounts of time maneuvering around the retail store while mixing and matching the individually packaged accouterments. Moreover, the retail stores require a variety of fixtures and displays and even more space to situate the fixtures and displays to sell known accouterments for wrapping gifts.

A need, therefore, exists for a kit and/or a method for storing and/or for displaying gift wrapping, such as, for example, a roll of wrapping paper and/or accessories, such as, for example, ribbon, a greeting card, an envelope and/or the like. Additionally, a need exists for a kit and/or a method for storing and/or for displaying gift wrapping and/or accessories that may display all of the gift wrapping and/or accessories in a single package.

Further, a need exists for a kit and/or a method for storing and/or for displaying gift wrapping and/or accessories that may resist crushing of the gift wrapping and/or the accessories. Still further, a need exists for a kit and/or a method for storing and/or for displaying gift wrapping and/or accessories that may be stacked with another like kit. Still further, a need exists for a kit and/or a method for storing and/or for displaying gift wrapping and/or accessories that may display all the gift wrapping and/or accessories required to wrap a single gift.

Still further, a need exists for a kit and/or a method for storing and/or for displaying gift wrapping and/or accessories that may require less retail space to display the gift wrapping and/or accessories for sale. Still further, a need exists for a kit and/or a method for storing and/or for displaying gift wrapping and/or accessories that may be displayed on any shelf or fixture in retail stores. Still further, a need exists for a kit and/or a method for storing and/or for displaying gift wrapping and/or accessories that may eliminate a need for a cylindrical tube for storage of the gift wrapping.

Still further, a need exists for a kit and/or a method for storing and/or for displaying gift wrapping and/or accessories that may reduce the time required for a purchaser to select the gift wrapping and or accessories in a retail store environment. Still further, a need exists for a kit and/or a method for storing and/or for displaying gift wrapping and/or accessories that may reduce a shipping weight of the packaging for the gift wrapping and/or accessories. Moreover, a need exists for a kit and/or a method for storing and/or for displaying gift wrapping and/or accessories that may maximize use of space in shipping containers, such as, for example corrugated boxes.

SUMMARY OF THE INVENTION

The present invention generally relates to a kit and/or a method for storing and/or for displaying gift wrapping and/or accessories. More specifically, the present invention relates to a kit and/or a method for storing and/or for displaying gift wrapping, such as, for example, a roll of wrapping paper and/or accessories, such as, for example, ribbon, a greeting card, an envelope and/or the like. The kit and/or the method may have a sleeve and an insert that may be sized for insertion into the sleeve.

The sleeve may be preferably constructed from a transparent and/or a translucent material to allow for viewing of the insert and/or contents of the sleeve. The sleeve may form a compartment that may have, preferably, a triangular cross-section. The triangular cross-section may allow other like sleeves to be stacked and/or displayed in a complementary configuration. The sleeve may be formed by a plurality of walls that may be suitable to resist crushing of the contents of the sleeve.

The insert may be constructed from a semi-rigid and/or a rigid material. The insert may be sized to have approximately a same surface area as at least one of the plurality of walls of the sleeve. After insertion into the sleeve, the insert may provide additional stability to the sleeve to protect the contents as it may be situated adjacent to at least one of the plurality of walls of the sleeve. Further, the accessories, such as, for example, an envelope, a greeting card and/or the like may be affixed to the insert between the insert and one of the plurality of walls of the sleeve to maintain a position of the accessories for display through the sleeve. Further, accessories, such as, for example, ribbon may be wound around the insert within preferably, two or more notches on the insert. As such, the accessories may be safely encased in the sleeve and may be displayed on the insert in a variety of configurations. The gift wrapping may be safely encased in the sleeve and may be visible through one or more of the plurality of walls and/or through a cutout in the insert.

To this end, in an embodiment of the present invention, a kit for displaying gift wrapping and an accessory is provided. The kit has a sleeve that forms a compartment therein wherein the sleeve has a wall having a first end and a second end wherein a cross-section of the sleeve at a plane between the first end of the wall and the second end of the wall has a geometric shape. Further, the kit has an insert within the compartment having a first side and a second side wherein the second side is positioned opposite to the first side wherein the accessory is affixed to the first side of the insert between the first side of the insert and the wall wherein the gift wrapping is situated within the compartment adjacent to the second side of the insert. Moreover, the kit has a first see-through portion on the sleeve wherein the accessory and the gift wrapping are viewable through the first see-through portion.

In an embodiment, the kit has a notch in the insert and ribbon wrapped around the insert and disposed in the notch.

In an embodiment, the first see-through portion is transparent.

In an embodiment, the first see-through portion is a cutout in the sleeve.

In an embodiment, the kit has a second see-through portion on the insert wherein the gift wrapping is viewable through both the first see-through portion and the second see-through portion.

In an embodiment, the kit has a second see-through portion on the insert wherein the second see-through portion is a cutout in the insert wherein the gift wrapping is viewable through both the first see-through portion and the second see-through portion.

In an embodiment, the kit has a second see-through portion on the insert wherein the second see-through portion is transparent wherein the gift wrapping is viewable through both the first see-through portion and the second see-through portion.

In an embodiment, the accessory is a greeting card wherein the greeting card has indicia printed thereon.

In an embodiment, the accessory is an envelope having a plurality of flaps and an adhesive wherein the adhesive is associated with one of the plurality of flaps.

In an embodiment, the kit has a second accessory affixed to the first side of the insert between the first side of the insert and the wall wherein the second accessory is viewable through the first see-through portion.

In an embodiment, the kit has an adhesive that affixes the accessory to the insert.

In an embodiment, the geometric shape is selected from the group consisting of a triangle, a square, a rectangle, a polygon, a circle and an oval.

In another embodiment, a kit for wrapping only a single gift is provided. The kit has a sleeve having a length wherein the sleeve has a plurality of walls that form a first compartment wherein the sleeve has a generally triangular cross-section. Further, the kit has a sheet of wrapping paper having a first side and a second side wherein the second side is positioned opposite to the first side wherein the sheet of wrapping paper is rolled to form a tube and further wherein the tube is situated within the first compartment of the sleeve wherein the first side of the sheet of wrapping paper has a first pattern printed thereon. Still further, the kit has a greeting card adjacent to one of the plurality of walls between the tube and one of the plurality of walls wherein the greeting card has indicia. Still further, the kit has an envelope adjacent to one of the plurality of walls between the tube and one of the plurality of walls wherein the envelope has a second compartment sized to receive the greeting card. Moreover, the kit has a ribbon adjacent to one of the plurality of walls between the tube and one of the plurality of walls.

In an embodiment, the kit has an insert sized to fit within the first compartment adjacent to one of the plurality of walls of the sleeve wherein the greeting card and the envelope are affixed to the insert.

In an embodiment, the kit has an adhesive on the card and the envelope wherein the adhesive affixes the card and the envelope.

In an embodiment, the sleeve is transparent.

In an embodiment, the kit has a second pattern printed on the second side of the sheet of wrapping paper wherein the second pattern is distinct from the first pattern.

In another embodiment, a method for packaging wrapping paper and an accessory wherein the wrapping paper has indicia and further wherein the accessory has indicia wherein the indicia of the accessory match the indicia of the wrapping paper is provided. The method has the step of providing a sleeve having a plurality of walls forming a compartment sized to receive the wrapping paper and the accessory wherein the sleeve has a see-through portion. Further, the method has the step of inserting a member into the sleeve wherein the member is adjacent to one of the plurality of walls. Still further, the method has the step of affixing the accessory to the member. Still further, the method has the step of positioning the member within the sleeve adjacent to one of the plurality of walls of the sleeve wherein the accessory is positioned between the member and one of the plurality of walls of the sleeve and viewable through the see-through portion of the sleeve. Moreover, the method has the step of positioning the wrapping paper in the compartment of the sleeve adjacent to the member and viewable through the see-through portion of the sleeve.

In an embodiment, the method has the step of affixing a second accessory to the member wherein the second accessory is positioned between the member and one of the plurality of walls and viewable through the see-through portion of the sleeve.

In an embodiment, the method has the steps of providing a second see-through portion in the member and positioning the member within the sleeve wherein the wrapping paper is viewable through both the first see-through portion and the second see-through portion.

It is, therefore, an advantage of the present invention to provide a kit and/or a method for storing and/or for displaying gift wrapping and/or accessories.

Another advantage of the present invention is to provide a kit and/or a method for storing and/or for displaying gift wrapping, such as, for example, a roll of wrapping paper and/or accessories, such as, for example, ribbon, a greeting card, an envelope and/or the like.

And, another advantage of the present invention is to provide a kit and/or a method for storing and/or for displaying gift wrapping and/or accessories that may have a sleeve to protect the gift wrapping and/or the accessories.

Yet another advantage of the present invention is to provide a kit and/or a method for storing and/or for displaying gift wrapping and/or accessories that may have an insert that may be sized for insertion into the sleeve to provide rigidity to the sleeve.

A further advantage of the present invention is to provide a kit and/or a method for storing and/or for displaying gift wrapping and/or accessories that may have a sleeve that may be constructed from a transparent and/or a translucent material to allow for viewing of the insert and/or contents of the sleeve. Alternatively, the present invention may have a sleeve that may be made from an opaque material having strategically-placed windows to allow for viewing of the insert and/or the contents of the sleeve.

Moreover, an advantage of the present invention is to provide a kit and/or a method for storing and/or for displaying gift wrapping and/or accessories that may have a sleeve that may form a compartment that may have, for example, a triangular cross-section.

And, another advantage of the present invention is to provide a kit and/or a method for storing and/or for displaying gift wrapping and/or accessories that may have a sleeve that may allow other like sleeves to be stacked and/or displayed in a complementary configuration.

Yet another advantage of the present invention is to provide a kit and/or a method for storing and/or for displaying gift wrapping and/or accessories that may have a sleeve that may resist crushing of the contents of the sleeve.

Another advantage of the present invention is to provide a kit and/or a method for storing and/or for displaying gift wrapping and/or accessories that may have an insert that may be constructed from a semi-rigid and/or a rigid material to provide additional stability to the sleeve.

Yet another advantage of the present invention is to provide a kit and/or a method for storing and/or for displaying gift wrapping and/or accessories that may display all of the gift wrapping and/or accessories in a single package.

A still further advantage of the present invention is to provide a kit and/or a method for storing and/or for displaying gift wrapping and/or accessories that may display all the gift wrapping and/or accessories required to wrap a single gift.

Moreover, an advantage of the present invention is to provide a kit and/or a method for storing and/or for displaying gift wrapping and/or accessories that may require less retail space to display the gift wrapping and/or accessories for sale.

And, another advantage of the present invention is to provide a kit and/or a method for storing and/or for displaying gift wrapping and/or accessories that may be displayed on a shelf in retail stores.

Yet another advantage of the present invention is to provide a kit and/or a method for storing and/or for displaying gift wrapping and/or accessories that may eliminate a need for a cylindrical tube for storage of the gift wrapping.

Moreover, an advantage of the present invention is to provide a kit and/or a method for storing and/or for displaying gift wrapping and/or accessories that may reduce the time required for a purchaser to select the gift wrapping and or accessories in a retail store environment.

And, another advantage of the present invention is to provide a kit and/or a method for storing and/or for displaying gift wrapping and/or accessories that may be reduce a shipping weight of the packaging for the gift wrapping and/or accessories.

Yet another advantage of the present invention is to provide a kit and/or a method for storing and/or for displaying gift wrapping and/or accessories that may maximize use of space in shipping containers, such as, for example corrugated boxes.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

Figure 1:
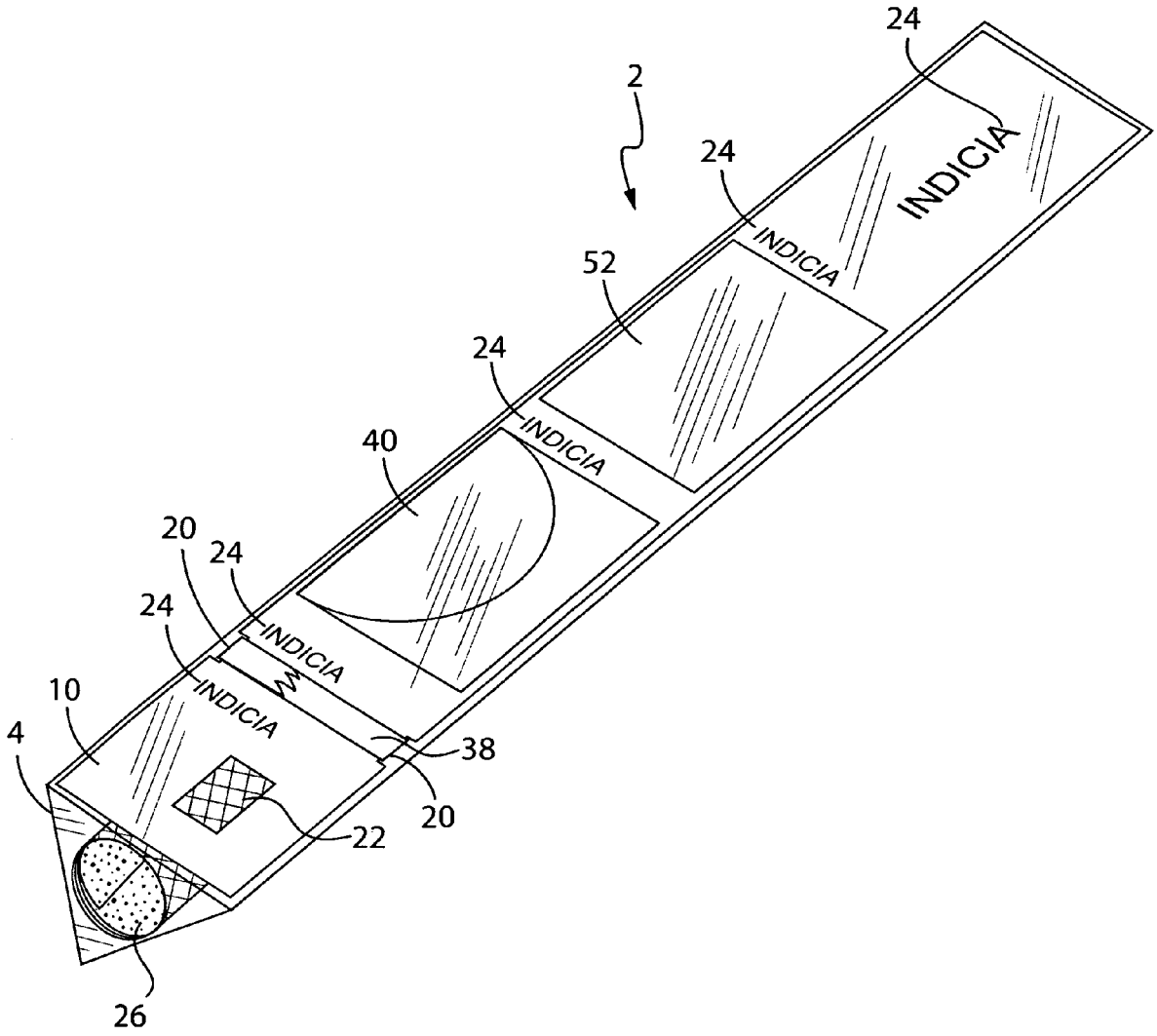
FIG. 1 illustrates a perspective view of a kit for storing and/or for displaying gift wrapping and/or accessories in an embodiment of the present invention.

The present invention generally relates to a kit and/or a method for storing and/or for displaying gift wrapping and/or at least one accessory. More specifically, the present invention relates to a kit and/or a method for storing and/or for displaying gift wrapping, such as, for example, a roll of wrapping paper and/or a decorative gift bag and/or at least one accessory, such as, for example, ribbon, adhesive tape, a bow, a greeting card, an envelope and/or the like. It should be understood that the gift wrapping and/or the accessories may be any gift wrapping and/or accessories for wrapping a gift as known to one having ordinary skill in the art.

Referring now to the drawings wherein like numerals refer to like parts, FIGS. 1-4 generally illustrate a preferred embodiment of a kit 2 that may have a sleeve 4 and an insert 10 for storing and/or for displaying gift wrapping and/or accessories. The gift wrapping, the accessories and/or the insert may be sized for storage and/or for display within the sleeve 4.

Figure 3:
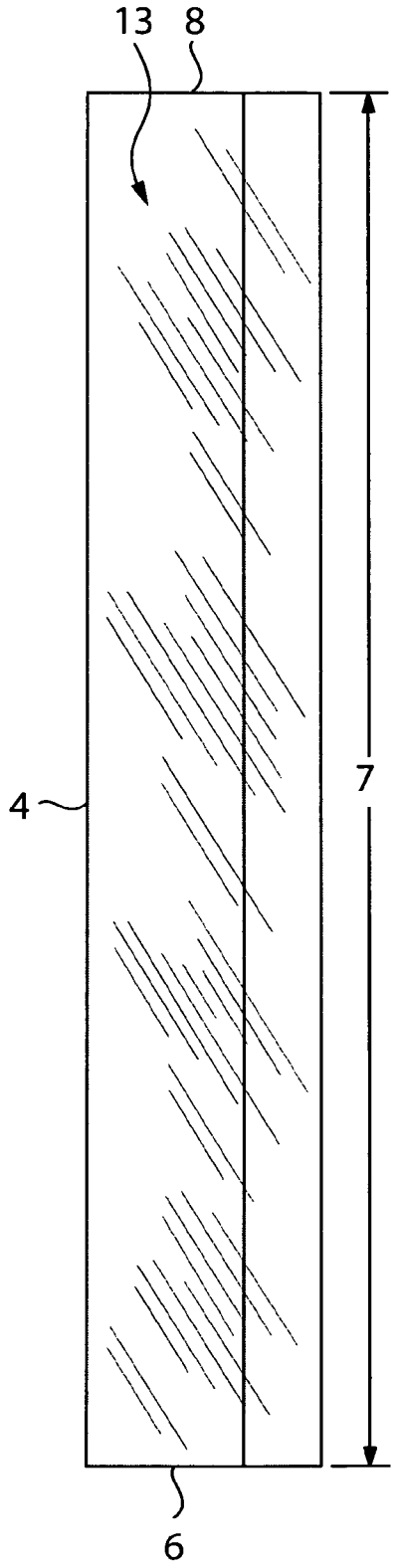
FIG. 3 illustrates a plan view of an assembled sleeve for storing and/or for displaying gift wrapping and/or accessories in an embodiment of the present invention.
Figure 4:
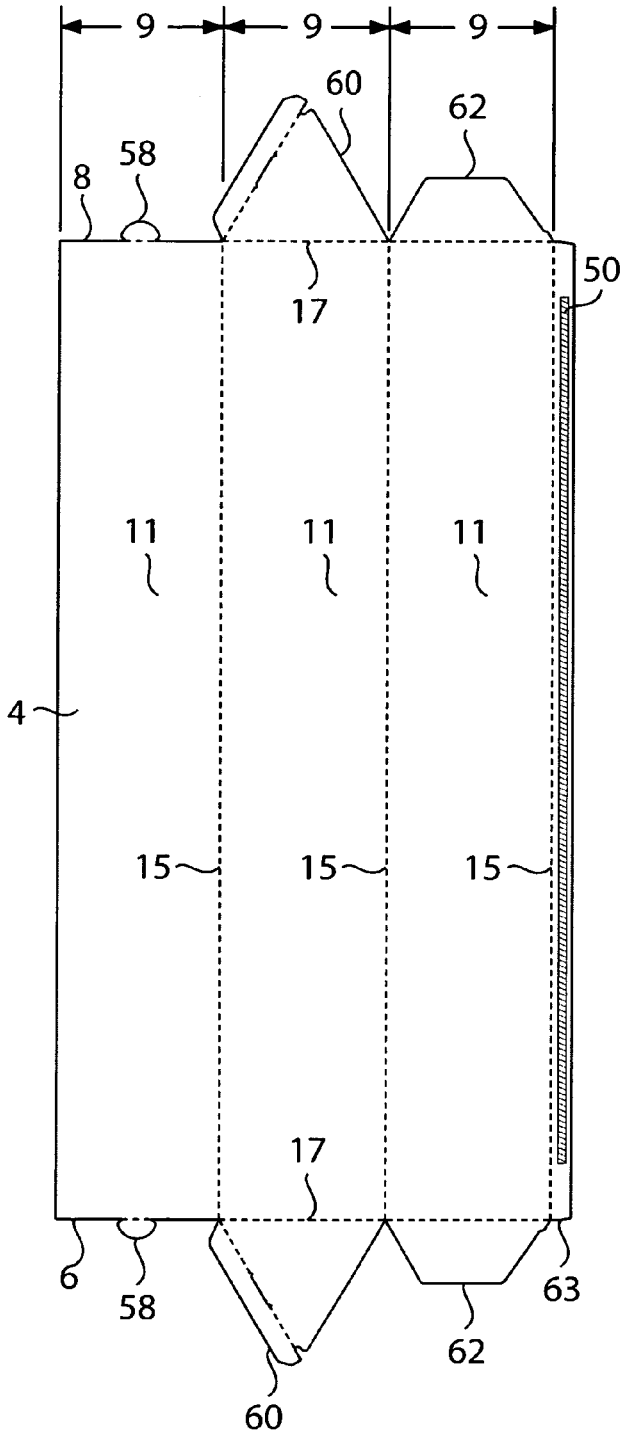
FIG. 4 illustrates a plan view of a disassembled sleeve for storing and/or for displaying gift wrapping and/or accessories in an embodiment of the present invention.
Figure 5:
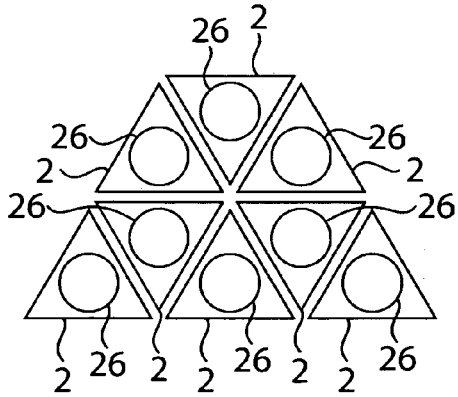
FIG. 5 illustrates a side view of a plurality of stacked kits for storing and/or for displaying gift wrapping and/or accessories in an embodiment of the present invention.

As illustrated in FIG. 3, the sleeve 4 may have a length 7 defined between a first end 6 and a second end 8 that may be positioned opposite to the first end 6. As illustrated in FIGS. 1 and 5, the sleeve 4 may have a triangular cross-section formed by three walls 11. In an embodiment, the walls 11 may have a height 9, as illustrated in FIG. 4. As a result, when assembled, the sleeve 4 may have a cross-section that may form an equilateral triangle. The walls 11 of the sleeve 4 may form a compartment 13 having a volume defined by the length 7 and the heights 9 of the walls 11. The sleeve 4 may be formed, folded and/or assembled from a die-cut sheet of material as illustrated in FIG. 4. The die-cut sheet of material may be scored and/or folded along score lines 15, 17 to form the assembled sleeve 4.

As illustrated in FIG. 4, one of the walls 11 may have a tab 58 extending from the first end 6 of the sleeve 4; one of the walls 11 may have a flap 60 extending from the first end 6 of the sleeve 4; and/or one of the walls 11 may have a flap 62 extending from the first end 6 of the sleeve 4. Further, one of the walls 11 may have a second tab 58 extending from the second end 8 of the sleeve 4; one of the walls 11 may have a second flap 60 extending from the second end 8 of the sleeve 4; and/or one of the walls 11 may have a second flap 62 extending from the second end 8 of the sleeve 4. Further, one of the walls 11 may have a tab 63 integrally formed therewith that may extend the length of the wall 11. The tab 63 may have an adhesive 50 to attach the wall 11 with another wall 11 in a folded configuration. Alternatively, the tab 63 may be inserted into a slot (not shown) in one of the walls 11 to form the assembled sleeve 4. The tab 63 may be folded along the score line 15 to form the assembled sleeve 4. The tabs 58, the flaps 60 and/or the flaps 62 may be folded along the score lines 17 to extend generally perpendicular with respect to the walls 11. The tabs 58, 63, the flaps 60 and/or the flaps 62 may be fitted together to hold the sleeve 4 in its assembled configuration (as shown in FIGS. 1 and 3) with a generally triangular cross-section. In an embodiment, the sleeve 4 may have a hanger tab (not shown) attached to the first end 6 and/or to the second end 8 to hang the sleeve 4 from a fixture for display. It should be understood that the sleeve 4 may have any tabs 58, 63, flaps 60 and/or flaps 62 as known to one having ordinary skill in the art. The present invention should not be deemed as limited to a specific embodiment of the tabs 58, 63, the flaps 60 and/or the flaps 62.

Figure 21:
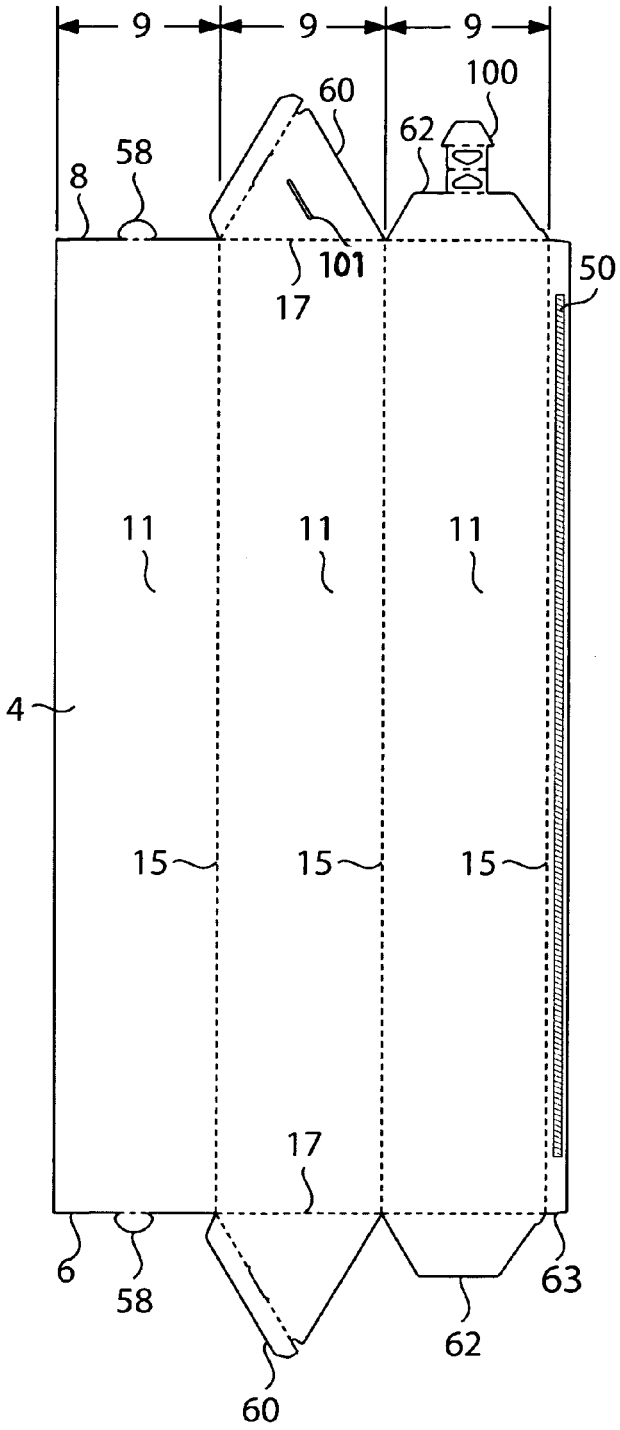
FIG. 21 illustrates a plan view of a disassembled sleeve for storing and/or for displaying gift wrapping and/or accessories in an embodiment of the present invention.
Figure 22:
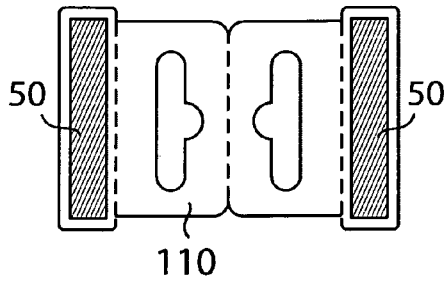
FIG. 22 illustrates a plan view of a hanger for a kit for storing and/or for displaying gift wrapping and/or accessories in an embodiment of the present invention.

As illustrated in FIG. 21, the sleeve 4 may have a hanger 100 integrally formed with the flap 62 at the second end 8 of the sleeve 4. The flap 60 may have a slot 101 for receiving the hanger 100 through the sleeve 4 in an assembled configuration. The hanger 100 may be used to hang the kit 2 from a fixture for display. As illustrated in FIG. 22, the kit 2 may have a hanger 110 that may have the adhesive 50 that may attach the hanger 110 to the first end 6 and/or the second end 8 of the sleeve 4.

In embodiments as shown in FIGS. 13-17, the sleeve 4 may have alternative cross-sections, such as, for example, square, rectangular, hexagonal, polygonal, circular, oval and/or the like. Moreover, although the preferred embodiment shows the cross-sectional shape of the sleeve 4 as an equilateral triangle, any other triangular cross-section is contemplated, such as a right triangle, an isosceles triangle and a scalene triangle, for example. In a preferred embodiment as shown in FIG. 5, the cross-section may be such that a plurality of the kits 2 may be stacked in a complementary way to maximize use of a volume in a given space. It should be understood that the sleeve 4 may have any cross-section for forming a compartment as known to one having ordinary skill in the art. The present invention should not be deemed as limited to a specific embodiment of the cross-sectional shape of the sleeve 4.

In an embodiment, the sleeve 4 may be constructed from a material, such as, for example, a polyvinyl chloride (PVC), a plastic material, a corrugated paper, a cardboard, a metallic material and/or the like that may protect contents of the sleeve 4. Further, the sleeve 4 may be constructed from a recyclable material and/or from post-consumer recycled materials. The sleeve 4 may be constructed from materials having varying degrees of transparency. The sleeve 4 may be transparent, translucent, opaque and/or may be a combination of transparent, translucent and/or opaque. In a preferred embodiment, the sleeve 4 is constructed from a transparent material to fully view the contents within the sleeve 4.

Alternatively, the walls 11 of the sleeve 4 may be opaque; however, the walls 11 may have windows of transparency to allow the contents of the sleeve 4 to be visible. In another embodiment, the walls 11 of the sleeve may be translucent and may have windows of transparency to allow the contents of the sleeve 4 to viewed. The walls 11 of the sleeve may have a coating and/or a paint which may create an opaqueness and/or a translucency. Further, the sleeve 4 may have cutouts in the walls 11 that may allow the contents of the sleeve 4 to be viewed in instances wherein the walls 11 are opaque and/or translucent. It should be understood that the sleeve 4 may be constructed from any material as known to one having ordinary skill in the art. The present invention should not be deemed as limited to a specific material for construction of the sleeve 4.

Figure 2:
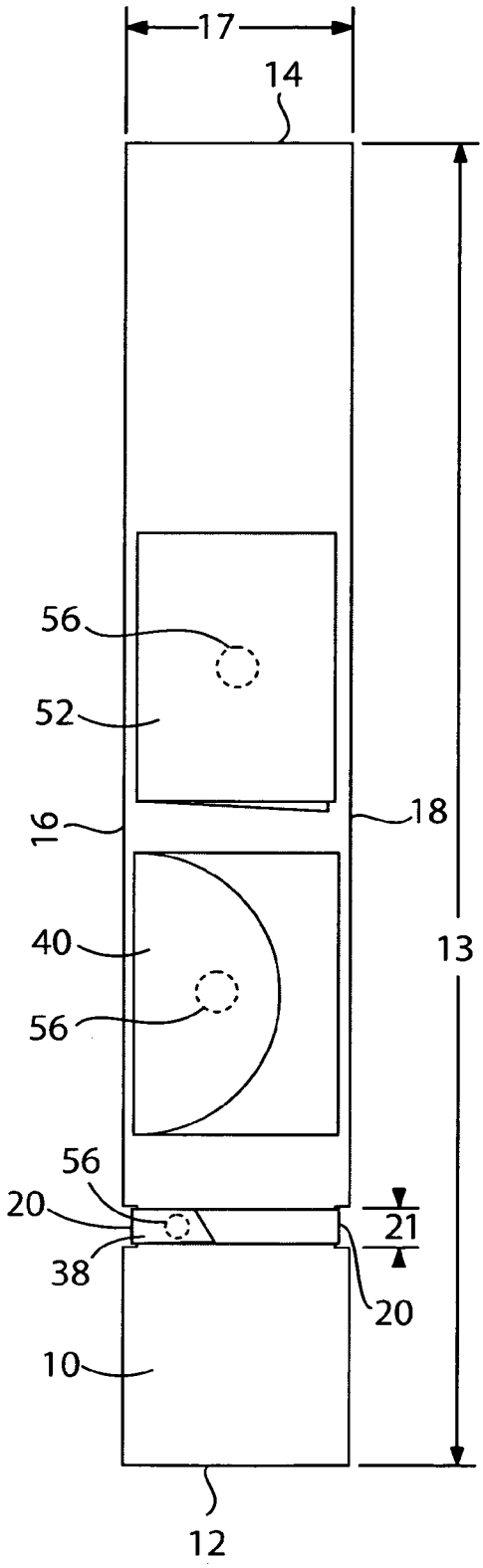
FIG. 2 illustrates a plan view of an insert for storing and/or for displaying gift wrapping and/or accessories in an embodiment of the present invention.

As illustrated in FIGS. 1 and 2, the kit 2 may have an insert 10 that may be sized for slidable insertion into the sleeve 4. One or more of the accessories, such as, for example, a card, an envelope, a length of ribbon and/or the like may be secured to and/or fastened to the insert 10 before sliding the insert 10 into the sleeve 4. In a preferred embodiment, as illustrated in FIG. 2, the insert 10 may be generally rectangular in shape. The insert 10 may have a length 13 defined between a first end 12 and second end 14 that may be positioned opposite to the first end 12. The insert 10 may have a height 17 defined between a top end 16 and a bottom end 18 that may be positioned opposite to the top end 16. The length 13 of the insert 10 may be less than the length 7 of the sleeve 4, and the height 17 of the insert 10 may be less than the height 9 of at least one of the walls 11 of the sleeve 4.

Figure 12:
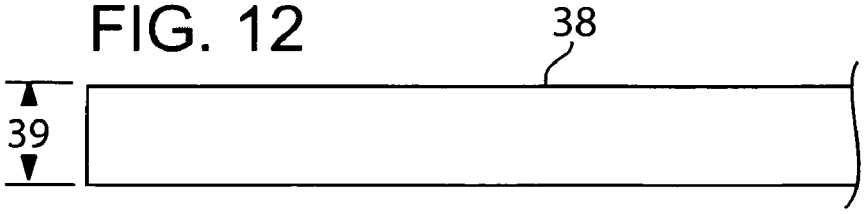
FIG. 12 illustrates a plan view of ribbon of a kit for storing and/or for displaying gift wrapping and/or accessories in an embodiment of the present invention.
Figure 13:
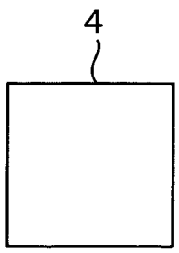
FIG. 13 illustrates a cross-sectional view of a sleeve of a kit for storing and/or for displaying gift wrapping and/or accessories in an embodiment of the present invention.
Figure 14:
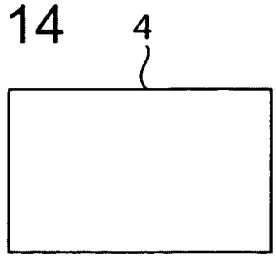
FIG. 14 illustrates a cross-sectional view of a sleeve of a kit for storing and/or for displaying gift wrapping and/or accessories in an embodiment of the present invention.
Figure 15:
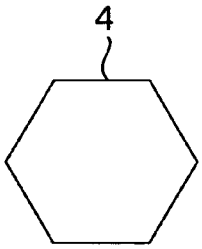
FIG. 15 illustrates a cross-sectional view of a sleeve of a kit for storing and/or for displaying gift wrapping and/or accessories in an embodiment of the present invention.
Figure 16:
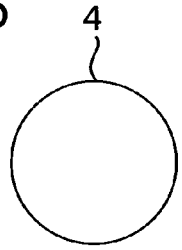
FIG. 16 illustrates a cross-sectional view of a sleeve of a kit for storing and/or for displaying gift wrapping and/or accessories in an embodiment of the present invention.
Figure 17:
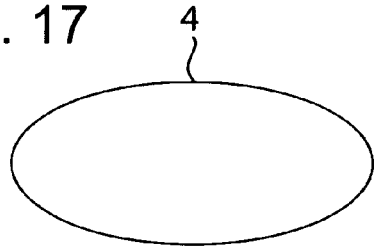
FIG. 17 illustrates a cross-sectional view of a sleeve of a kit for storing and/or for displaying gift wrapping and/or accessories in an embodiment of the present invention.

The insert 10 may have one or more notches 20 along the length of the insert 10 on the top end 16 and/or on the bottom end 18 of the insert 10. The notches 20 may have a width 21 that may be sized to receive one or more of the accessories, such as, for example, ribbon 38. In an embodiment, the ribbon 38, as illustrated in FIG. 12, may have a width 39 that may allow the ribbon 38 to be wound around the insert 10 within the notches 20 in a spool-like fashion. Accordingly, the width 39 of the ribbon 38 may be less than the width 21 of the notches 20.

The insert 10 may be constructed from a variety of materials, such as, for example card stock, corrugated paper, plastic and/or like material that may have sufficient rigidity to avoid deformation by a weight of the accessories that may be placed and/or displayed thereon.

Figure 18:
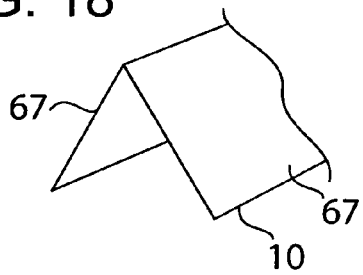
FIG. 18 illustrates a perspective view of an insert for a kit for storing and/or for displaying gift wrapping and/or accessories in an embodiment of the present invention.
Figure 19:
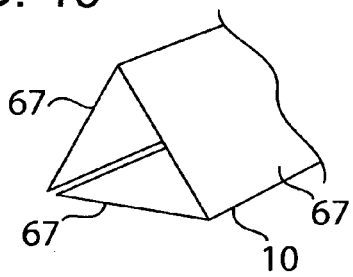
FIG. 19 illustrates a perspective view of an insert for a kit for storing and/or for displaying gift wrapping and/or accessories in an embodiment of the present invention.
Figure 20:
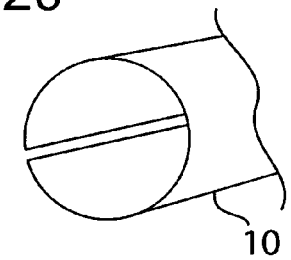
FIG. 20 illustrates a perspective view of an insert for a kit for storing and/or for displaying gift wrapping and/or accessories in an embodiment of the present invention.

In embodiments as illustrated in FIGS. 18 and 19, the insert 10 may have two or more leaves 67 that may be scored and/or folded and may be situated adjacent to the walls 11 of the sleeve 4. In an embodiment as illustrated in FIG. 20, the insert 10 may be bent and/or molded in a shape suitable for slidable insertion into the sleeve 4.

In a preferred embodiment, as shown in FIG. 1, the insert 10 may be generally opaque and may further have a cutout 22 that may allow the contents of the sleeve 4 that may be situated behind the insert 10 to be viewed through the insert 10. The insert 10 may have various indicia 24 printed and/or formed thereon for labeling the contents of the sleeve 4 and/or to convey other information about kit 2, such as, for example, a UPC code, one or more trademarks, manufacturing information, further details about the contents and/or the like. The present invention should not be deemed as limited to a specific embodiment of the cutout 22 and/or the indicia 24. In an alternate embodiment, the insert 10 may be transparent, translucent, or a combination of opaque, transparent and/or translucent for easily viewing the contents of the sleeve 4.

In a preferred embodiment, the insert 10 may have one or more of the accessories affixed thereto. As illustrated in FIGS. 1 and 2, one or more of the accessories, such as, for example, a card 52, and/or an envelope 40 may be affixed to and/or displayed on the insert 10. The accessories may be preferably affixed to the insert 10 with an adhesive, such as, for example, a low-tack glue dot 56. Further, the ribbon 38 may be held in place with the adhesive.

Figure 6:
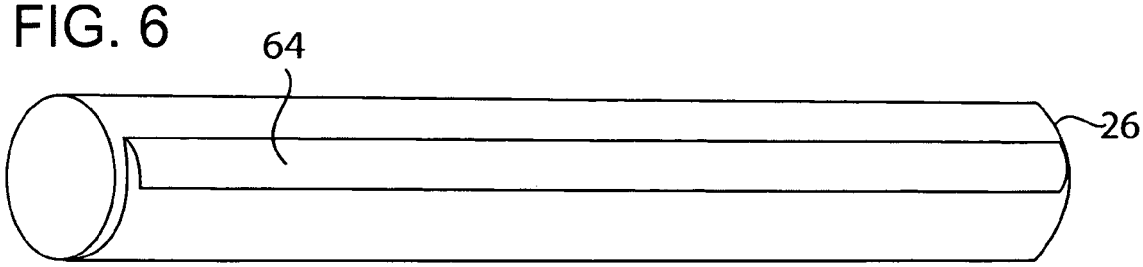
FIG. 6 illustrates a plan view of a roll of wrapping paper of a kit for storing and/or for displaying gift wrapping and/or accessories in an embodiment of the present invention.
Figure 7:
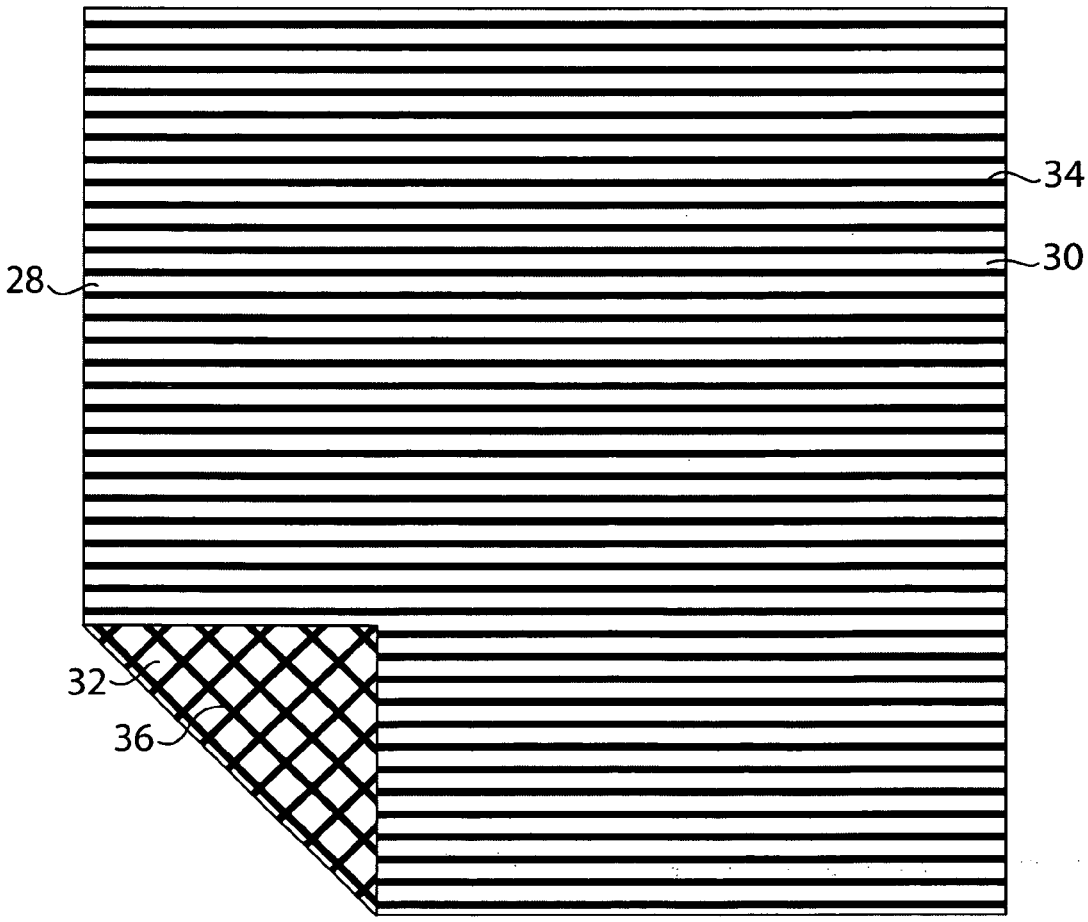
FIG. 7 illustrates a plan view of a sheet of wrapping paper of a kit for storing and/or for displaying gift wrapping and/or accessories in an embodiment of the present invention.

In a preferred embodiment as illustrated in FIGS. 6 and 7, the gift wrapping may be, for example, a sheet of wrapping paper 28 that may have a first side 30 and a second side 32 that may be positioned opposite to the first side 30. The first side 30 of the sheet of wrapping paper 28 may have a first decorative pattern 34, and the second side 32 of the sheet of wrapping paper 28 may have a second decorative pattern 36. The second decorative pattern 36 may be unique as compared to the first decorative pattern 34. The sheet of wrapping paper 28 may be rolled into a cylindrical configuration as shown in FIG. 6. Further, an exposed end of the sheet of the rolled wrapping paper 28 may have a fold 64 to expose the second decorative pattern 36. The sheet of the rolled wrapping paper 28 may be slidably inserted into the compartment 13 of the sleeve 4, preferably, between one or more of the walls 11 of the sleeve 4 and the insert 10. The present invention should not be deemed as limited to a specific embodiment of the sheet of wrapping paper 28, the first decorative pattern 34 and/or the second decorative pattern 36.

Figure 8:
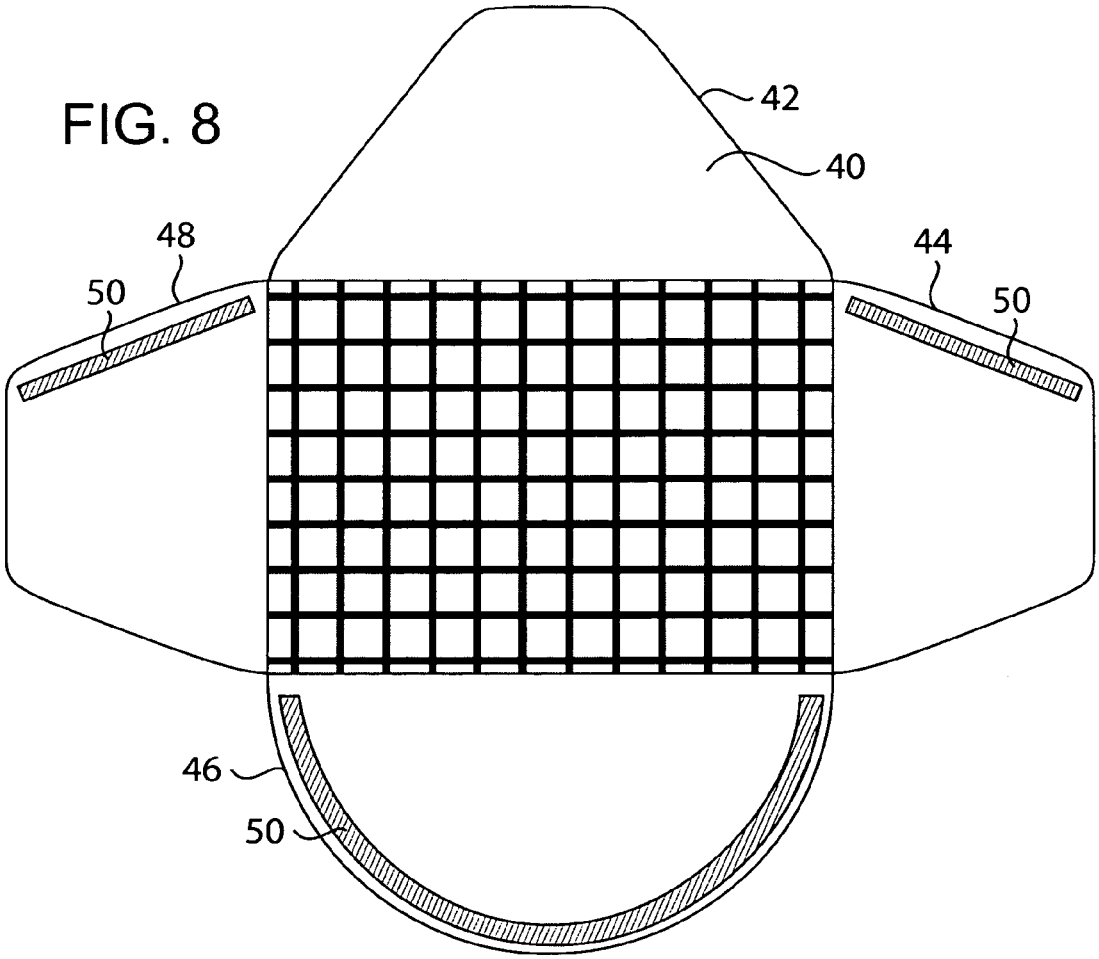
FIG. 8 illustrates a plan view of a disassembled envelope of a kit for storing and/or for displaying gift wrapping and/or accessories in an embodiment of the present invention.
Figure 9:
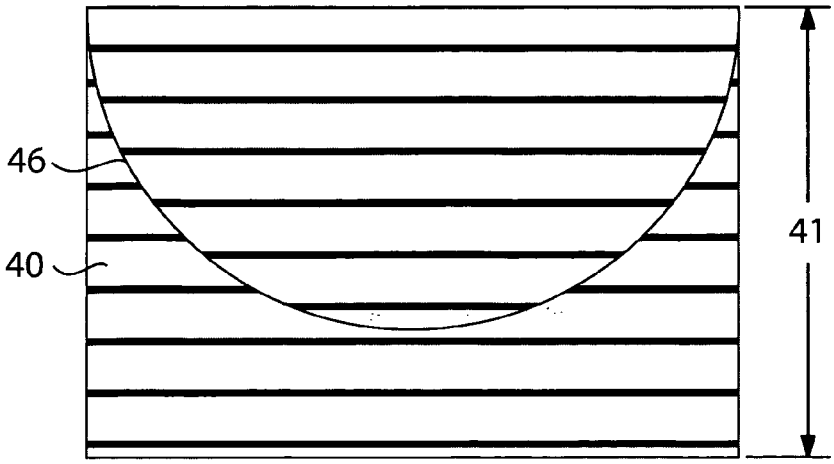
FIG. 9 illustrates a plan view of an assembled envelope of a kit for storing and/or for displaying gift wrapping and/or accessories in an embodiment of the present invention.

FIG. 8 illustrates a preferred embodiment of the envelope 40 in an unassembled state. As illustrated in FIG. 9, the envelope 40 may have a height 41 that may be less than the height 17 of the insert 10 and the height 7 of the sleeve 4. Referring again to FIG. 8, the envelope 40 may have flaps 42, 44, 46, 48 and/or may have an adhesive 50 on the flaps 44, 46, 48 for holding the envelope together in an assembled state as shown in FIG. 9. The envelope 40 may have the first decorative pattern 34 and/or the second decorative pattern 36 printed and/or formed thereon. It should be understood that the envelope 40 may be any envelope as known to a person of ordinary skill in the art. The present invention should not be deemed as limited to a specific embodiment of the envelope 40, the flaps 42, 44, 46, 48 and/or the adhesive 50.

Figure 10:
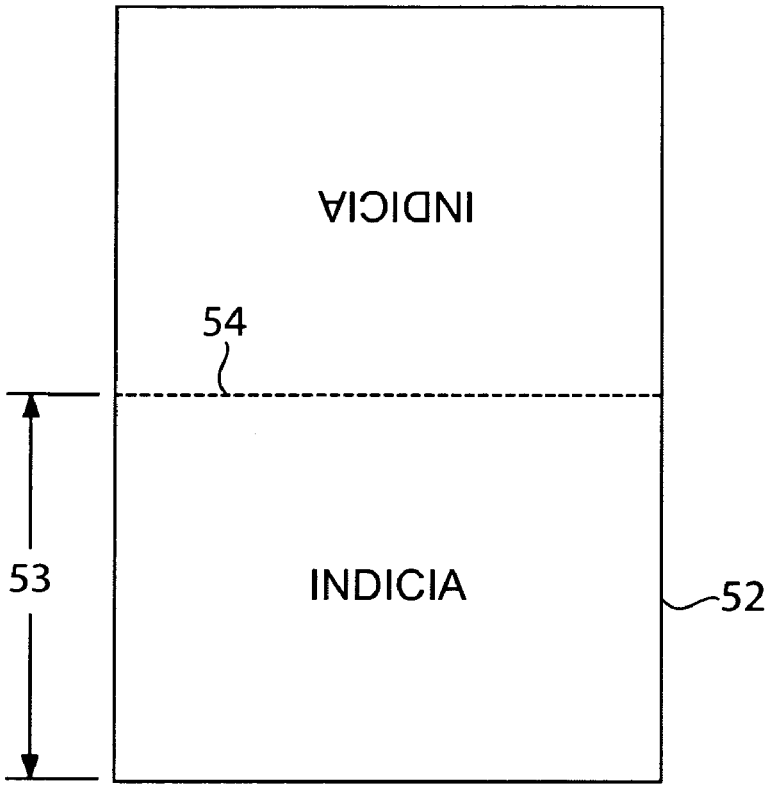
FIG. 10 illustrates a plan view of a disassembled card of a kit for storing and/or for displaying gift wrapping and/or accessories in an embodiment of the present invention.
Figure 11:
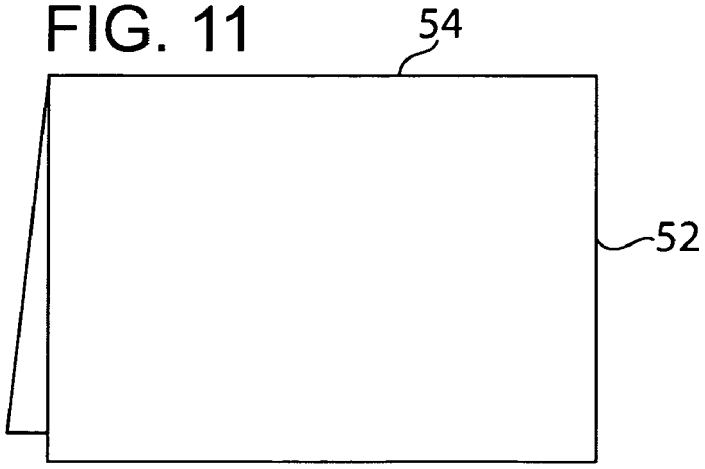
FIG. 11 illustrates a plan view of an assembled card of a kit for storing and/or for displaying gift wrapping and/or accessories in an embodiment of the present invention.

FIG. 10 illustrates a preferred embodiment of the card 52 in an unassembled state. As illustrated in FIG. 11, the card 52 may have a height 53 that may be less than the height 17 of the insert 10 and the height 7 of the sleeve 4. The card 52 may have a score/fold line 54 for folding the card into an assembled state as shown in FIG. 11. The card 52 may have the first decorative pattern 34 and/or the second decorative pattern 36 printed and/or formed thereon. It should be understood that the card 52 may be any greeting card or announcement card as known to a person of ordinary skill in the art. The present invention should not be deemed as limited to a specific embodiment of the card 52.

The present invention may be used with or without the insert 10. In an embodiment of the kit 2 without the insert 10, the rolled sheet of wrapping paper 26 may be inserted into the compartment 13 of the sleeve 4. The card 52 and/or the envelope 40 may be disposed within the compartment 13. Specifically, the card 52 and/or the envelope 40 may be secured to one or more of the walls 11 of the sleeve 4 within the compartment 13 with an adhesive, such as, for example, a low-tack glue dot. Alternatively, the card 52 and/or the envelope 40 may be secured to one or more of the walls 11 of the sleeve 4 on the outside of the sleeve 4. The ribbon 38 may be affixed to one of the walls 11 of the sleeve 4 and/or may be secured around the rolled sheet of wrapping paper 26. The sleeve 4 may be opaque in places, transparent in places and/or translucent in places to allow a purchaser to view the contents of the sleeve, the first decorative pattern 34 and/or the second decorative pattern 36. The sleeve 4 may have a cutout to allow the purchaser to view the contents of the sleeve 4. Further the walls 11 of the sleeve 4 may have indicia printed and/or affixed thereon for conveying information to a purchaser.

In an embodiment of the kit 2 with the insert 10, the rolled sheet of wrapping paper 26 may be inserted into the compartment 13 of the sleeve 4 between of the walls 11 of the sleeve 4 and the insert 10. The card 52 and/or the envelope 40 may be secured to the insert with an adhesive, such as, for example, a low-tack glue dot. The ribbon 38 may be wound around the insert 10 between the notches 20 or through slits (not shown) in the insert 10. In an embodiment wherein the insert 10 has a plurality of sections joined by folds and/or score lines, the ribbon 38 may be wound around the insert 10 through one or more slits in the insert 10 and/or an outer edge of the insert 10. The sleeve 4 may be opaque in whole or in part, transparent in whole or in part and/or translucent in whole or in part to allow a purchaser to view the contents of the sleeve, the first decorative pattern 34 and/or the second decorative pattern 36. The sleeve 4 may have a cutout to allow the purchaser to view the contents of the sleeve 4 and/or the insert 10. Further, the insert 10 may have indicia printed and/or affixed thereon for conveying information to the purchaser through transparent and/or translucent portions of the sleeve 4 and/or through the cutout 22 in the sleeve. Further, the sleeve 4 may have indicia printed and/or affixed thereon.

In both embodiments, with or without the insert 10, the kit 2 may be stacked adjacent to other like kits 2 on shelves and/or fixtures in a retail store to display the gift wrapping and/or the accessories and/or to promote selection of the kit 2 by the purchaser at a single point of sale.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. A kit for gift wrapping accessories, the kit comprising:

a sleeve having a first end and a second end wherein the sleeve has a wall between the first end and the second end wherein a cross-section of the sleeve has a geometric shape;

a sheet of gift wrapping paper wherein the sheet is formed into a roll wherein the roll is located within the sleeve;

a greeting card located within the sleeve;

an insert within the sleeve wherein the insert has a first side and a second side wherein the first side of the insert is located adjacent to the wall of the sleeve wherein the greeting card is affixed to the first side of the insert between the first side of the insert and the wall of the sleeve wherein the roll is adjacent to the second side of the insert;

a first see-through portion on the sleeve wherein the first side of the insert, the greeting card and the roll are viewable through the first see-through portion; and a notch in the insert; and a ribbon wrapped around the insert and disposed in the notch.

2. The kit of claim 1 wherein the first see-through portion is transparent.

3. The kit of claim 1 wherein the first see-through portion is a cutout in the sleeve.

4. The kit of claim 1 further comprising:

a second see-through portion on the insert wherein the roll is viewable through both the first see-through portion and the second see-through portion.

5. The kit of claim 1 further comprising:

a second see-through portion on the insert wherein the second see-through portion is a cutout in the insert wherein the roll is viewable through both the first see-through portion and the second see-through portion.

6. The kit of claim 1 further comprising:

a second see-through portion on the insert wherein the second see-through portion is transparent wherein the roll is viewable through both the first see-through portion and the second see-through portion.

7. The kit of claim 1 further comprising:

indicia printed on the greeting card.

8. The kit of claim 1 further comprising:

an envelope within the sleeve wherein the envelope is sized to receive the greeting card wherein the envelope has a flap and an adhesive wherein the adhesive is associated with the flap wherein the envelope is affixed to the first side of the insert between the first side of the insert and the wall of the sleeve.

9. The kit of claim 1 further comprising:

indicia printed on the first side of the insert.

10. The kit of claim 1 further comprising:

an adhesive that affixes the greeting card to the first side of the insert.

11. The kit of claim 1 wherein the geometric shape is selected from the group consisting of a triangle, a square, a rectangle, a polygon, a circle and an oval.

12. A kit for wrapping only a single gift, the kit comprising:

a sleeve having a plurality of walls that form an interior of the sleeve wherein the sleeve has a generally triangular cross-section;

a sheet of wrapping paper having a first side and a second side wherein the sheet of wrapping paper is rolled to form a tube and further wherein the tube is situated within the sleeve wherein the first side of the sheet of wrapping paper has a first pattern printed thereon wherein the first pattern of the first side of the sheet of wrapping paper is viewable through the sleeve;

a greeting card between the tube and one of the plurality of walls wherein the greeting card has indicia wherein the greeting card is viewable through the sleeve;

an envelope between the tube and one of the plurality of walls wherein the envelope is sized to receive the greeting card wherein the envelope is viewable through the sleeve; and a ribbon between the tube and one of the plurality of walls wherein the ribbon is viewable through the sleeve; an insert sized to fit within the sleeve adjacent to one of the plurality of walls of the sleeve wherein the greeting card, the envelope and the ribbon are affixed to the insert.

13. The kit of claim 12 further comprising:

an adhesive on the card and the envelope wherein the adhesive affixes the card and the envelope to the insert.

14. The kit of claim 12 wherein the sleeve is transparent.

15. The kit of claim 12 further comprising:

a second pattern printed on the second side of the sheet of wrapping paper wherein the second pattern is distinct from the first pattern wherein the second pattern of the second side of the sheet of wrapping paper is viewable through the sleeve.

* * * * *